United States Patent [19]

Ferris

[11] 4,447,500

[45] May 8, 1984

[54] RELEASE COMPOSITIONS FOR ASPHALT ROOFING MATERIALS AND METHODS OF USE

[76] Inventor: John A. Ferris, 945 Meadow Crest Rd., LaGrange Park, Ill. 60525

[21] Appl. No.: 516,926

[22] Filed: Jul. 25, 1983

Related U.S. Application Data

[63] Continuation-in-part of Ser. No. 403,342, Jul. 30, 1982, abandoned.

[51] Int. Cl.[3] ..... B05D 3/02; B32B 11/00; C08L 91/00; C09D 3/26

[52] U.S. Cl. ..... 428/489; 106/243; 427/384; 427/385.5; 427/417; 428/906

[58] Field of Search ..... 106/243; 427/384, 385.5, 427/186, 417; 428/489, 906

[56] References Cited

U.S. PATENT DOCUMENTS 3,380,840 4/1968 Harrison ..... 106/243
4,203,856 5/1980 Pardee ..... 427/384 X

*Primary Examiner*—Michael R. Lusignan

[57] ABSTRACT

A release coating for asphalt roofing sheet material comprises a mixture of fatty acid monoalkanol amides such as a mixture of cocamide MEA and stearamide MEA. The amides may be applied as dilute aqueous solutions or dispersions, and may be used with both asphalt shingles and roll roofing.

12 Claims, 3 Drawing Figures

RELEASE COMPOSITIONS FOR ASPHALT ROOFING MATERIALS AND METHODS OF USE

CROSS REFERENCE

This application is a continuation-in-part of my copending application Ser. No. 403,342, filed July 30, 1982, now abandoned.

FIELD OF INVENTION, BACKGROUND, AND PRIOR ART

The field of this invention is release compositions for use on asphalt roofing materials, such as asphalt shingles and asphalt roll roofing. With respect to shingles which are provided on their upper sides with an adhesive strip, a release coating is used over the mating tape which is on the undersides of the shingles. For roll roofing, a release coating is usually applied to the top surface to prevent self-adherence when rolled.

Asphalt Shingles

In recent years standard asphalt shingles have been provided along their upper surfaces with adhesive patches or strips formed of an adhesive composition normally obtained as a solid coke-like residue from the cracking process in the refining of petroleum, one such material being available, for example, as asphalt shingle adhesive from Trumble Oil Company, Ill. Although solid at room temperatures, such an adhesive softens at elevated temperatures (about 120° F.), and is located across the midportion of the top surface of each shingle to bond that portion to the edge of an overlying shingle after the shingles have been applied to a roof and been heated by solar energy. While such adhesive patches have been notably effective in reducing problems of wind damage to applied shingles, they have also created problems by causing unwanted adherence when shingles are simply stacked for handling, shipment, and/or storage.

The usual means for preventing or reducing the unintended adherence between the shingles of a stack consists of providing the underside of each shingle with a longtitudinally-extending release tape formed of foil or a thermoplastic film (ordinarily polyester or vinyl film). The tape is located to overlie the adhesive patches of the underlying shingle when such shingles are stacked. Since such a release tape is not by itself completely effective in preventing adherence between the shingles, manufacturers commonly coat the release tapes with a coating material prepared by dissolving or emulsifying a wax or vegetable oil soap in water at dilution ratios in the range of about 5:1 to 10:1.

Various types of release coatings have been used for preventing the adherence of stacked shingles, some being more effective than others, but none has been known to be clearly superior and highly effective in all respects. Such a material should not only be relatively inexpensive and easily applied, but should prevent shingles from sticking together after they have been stacked and exposed to a wide range of temperature and pressure conditions and, at the same time, not impair the effectiveness of the adhesive patches in bonding adjacent shingles together in use. Specifically, using heat tests and pressure tests known in the industry, release coatings are considered unacceptable if more than 10% of the adhesive transfers to the adjacent shingle of a stack when such a stack is exposed to a temperature of 105° to 145° F. for 2 hours, or to a pressure of 100 pounds per square inch (psi) for at least 3 days. The same release coating must also have no deleterious effect on the adhesive, so that in a sealing test at 135° for 16 hours, in which the shingles are offset as they would appear on a roof following installation, at least 40% of the adhesive adheres to the other shingle (the extent of transfer is determined by forceably separating the shingles after they have been so treated and then measuring the proportion of adhesive on each). If current release agents pass such tests, they tend to do so at the outer limits of acceptability.

Coconut fatty acid monoethanol amide (commonly known as cocamide MEA) and stearic acid monoethanol amide (commonly known as stearamide MEA) are two "superamines" that are readily available commercially and are well known for a different use in an unrelated field, namely, as foam boosters, foam stabilizers, and viscosity enhancers for shampoos, lotions, and other cosmetic products. To the best of applicant's knowledge, such compounds have not previously been recognized as having value as release agents, much less as release agents suitable for use in preventing the adhesive bonding of stacked shingles.

Asphalt Roll Roofing

The better grades of roll roofing are presently formed from glass-ply mats impregnated with asphalt. Less expensive grades are made from felt mats impregnated with asphalt. With both kinds of roll roofing, it has been the practice to coat the top or upper surface of the roofing sheet materials with talc before being formed into rolls, the talc serving as a release agent to prevent the contacting surfaces from adhering while in roll form. A copious amount of talc is required for effective release action, the talc being applied by a dusting procedure. In plant operations, workers in the coating area are required to wear dust masks, and the talc in the air may constitute a health hazard elsewhere in the roofing plant. The cost of the talc and its application add substantially to the cost of producing the roll roofing. Further, in applying the roll roofing, the talc coating tends to come off which is objectionable to the roofers. Heretofore, however, no satisfactory substitute has been found for the talc, though other release agents have been tested, such as the soap-type release agents described above with respect to shingles.

SUMMARY OF INVENTION

The present invention is based in part on the discovery that effective release coatings for asphalt roofing sheet materials can be formed from fatty acid monoalkanol amides, such as stearic acid monoethanol amide (stearamide MEA) and coconut fatty acids monoethanol amide (cocamide MEA). This type of coating can be used on either the release tapes of shingles or on one or both sides of roll roofing. The amide release agents can be applied in the form of dilute suspensions and/or solutions in water so that the water quickly evaporates leaving the coating agents as a thin film. By this procedure, the release tapes of the shingles are more effectively prevented from adhering to the adhesive seal strips of the adjacent shingles. For roll roofing, the method can provide an important cost advantage over the use of talc, and can also eliminate the problems associated with the use of talc as described above.

In a preferred embodiment, a release coating is formed from a mixture of stearamide MEA and cocamide MEA, which may be used in similar weight amounts, such as around equal parts. The preferred embodiments of the method involve not only preferred proportions of these reagents, but also a special procedure for their application, as will be discussed in the detailed description.

THE DRAWING

The method of the present invention is shown in illustrative embodiments in the accompanying drawings, in which:

FIG. 1. is a perspective diagramatic showing of an apparatus system for coating roll roofing by the method of this invention;

FIG. 2. is a diagramatic elevational view of an apparatus system for using the method of this invention with asphalt shingles; and FIG. 3 is a perspective view of two asphalt shingles, the shingles being shown in separated relation to show the adhesive strip on the upper surface of one shingle and the mating release tape on the bottom surface of the other shingle.

DETAILED DESCRIPTION

Figure 1:
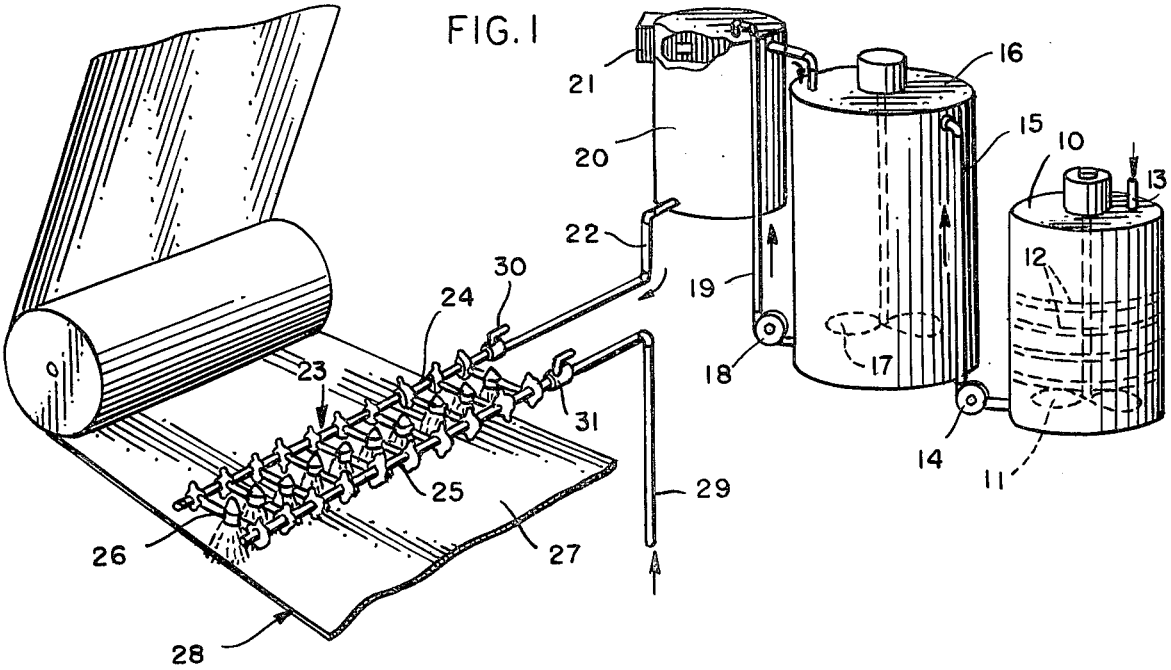

In its broadest aspect, this invention relates to a method of treating a surface of an asphalt roofing sheet material preparatory to stacking or rolling to prevent adherence of the treated surface to another surface of the roofing material. For this purpose, there is deposited on the surface to be treated a thin coating of fatty acid monoalkanol amides having the general formula:

$$R-\overset{\overset{\displaystyle O}{\|}}{C}-\overset{\overset{\displaystyle H}{|}}{N}-R_1OH$$

wherein R is an aliphatic hydrocarbon group containing from 11 to 17 carbons and $R_1$ is an alkyl group containing from 1 to 3 carbons.

For most effective action, it is believed desirable to use a mixture of amides containing long and short chain aliphatic groups. The long chain groups are derived from $C_{18}$ and/or $C_{16}$ fatty acids, such as stearic acid or palmitic acid. The shorter chain aliphatic groups are derived from $C_{12}$ and/or $C_{14}$ fatty acids, such as lauric and myristic acids. Such shorter chain amides may be prepared from coconut oil fatty acids. For example, in a preferred embodiment, this invention is practiced by blending together approximately equal proportions by weight of stearic acid monoethanol amide (stearamide MEA) and coconut fatty acid monoethanol amide (cocamide MEA). Such "superamides" are well known and available, for example, from Haag Laboratories Division of Millmaster Onyx, Blue Island, Ill., and from a number of other sources.

The structural formulas for stearamide MEA and cocamide MEA, respectively, are $$CH_3(CH_2)_{16}\overset{\overset{\displaystyle O}{\|}}{C}-NH-CH_2CH_2OH \text{ and}$$

$$R-\overset{\overset{\displaystyle O}{\|}}{C}-NH-CH_2CH_2OH, \text{ where } R-\overset{\overset{\displaystyle O}{\|}}{C}-$$

represents the coconut acid radical.

The preferred limits for each ingredient are believed to be 30 to 70 parts by weight of cocamide MEA to 70 to 30 parts of stearamide MEA, the optimum limits being from about 35–60: 60–35. Since both components are solids at room temperature, the blending should be undertaken at an elevated temperature (e.g., above 180° F.) at which such materials are liquified. Also, since superamides are of low solubility in water, it is advantageous to add a minor percentage of a suitable surfactant during blending operations, such surfactant later enhancing the stability of the dispersion when the homogeneous blend is cooled, comminuted, and dispersed in water. Any of a variety of commercially available surfactants may be used such as, for example, polyoxyethylene (9) nonyl phenyl ether (commonly, nonoxynol-9 or polyoxyethylene (10) nonyl phenyl ether (commonly, nonoxynol-10) marketed as Neutronyx 600 and Neutronyx 656, respectively, by Haag Laboratories Division of Millmaster Onyx, and other surfactants such as Tween 20 (C.P. Hall, Chicago, Ill.).

After the components are uniformly blended at elevated temperature, the mixture may be allowed to cool to room temperature and is then comminuted by a chipping or flaking operation. The dry, comminuted product is easily handled and may be readily shipped in that form to shingle manufacturers or other users. Thereafter, the material is prepared for use by dispersing and agitating it in water at elevated temperatures (e.g., 150° to 212° F.). Concentrations of from 0.5 to 2.5 parts of total amide per 100 parts of water are desirable. The solution or suspension is then allowed to cool, normally to about room temperature, and is applied to the release strips along the undersides of conventional asphalt shingles by rolling, wiping, brushing, or spraying, or other coating procedures. At room temperature, most of the amide material will be in the form of a fine particulate dispersion. A rolling procedure has been found particularly effective, but any of a variety of suitable applying techniques may be utilized. Following such treatment, either before or after complete drying of the release coating, the shingles may be stacked with the adhesive patches along the upper surfaces of the shingles in direct contact with the release coatings along the undersides of adjacent shingles.

The superiority of this release coating over prior release agents is demonstrated by several tests. In one such test, here referred to as the "heat test", two shingles are stacked and a square rod of steel having a one square inch cross section is placed over the top shingle directly over the area of contact between the adhesive patches and the coated release strip between the two shingles. The shingles are heated for two hours at a temperature within the range of 105° to 145° F. (usually about 130° F.). They are then split apart and the extent of adhesive transferred from one shingle to the other is measured. Anything above 10% is considered unacceptable; typical shingles with conventional soap release coatings generally produce results within the range of 3 to 8% transfer. When such shingles are instead coated with the preferred release agent of this invention, transfer is reduced to the range of zero to 1%.

The heat test may be performed under either wet or dry conditions, that is, the release coating may be allowed to dry on the shingles before they are stacked or the shingles may be stacked while the release coating is still wet. Testing under wet conditions is important for the purpose of determining whether the release coating material will operate satisfactorily even if used under expedited manufacturing operations that involve stacking of freshly-produced shingles without first drying the release coatings. Even when the heat test is conducted under wet conditions, the extent of transfer is found to fall within the range of zero to 1%.

The heat test is intended to indicate what might take place should stacked shingles be exposed to elevated temperatures during shipment, storage, or anytime prior to use. Another test, referred to as the 100 psi pressure test, involves stacking shingles at a contact pressure in excess of 100 psi at ambient (room) temperature for an interval of at least 3 days, normally 7 to 14 days, and again measuring the extent of transfer. When such a test is conducted with standard asphalt shingles having release strips coated with conventional release agents, the results generally reveal an extent of transfer within the range of 3 to 8% (more than 10% is unacceptable). Again, with standard shingles on which the release strips are coated with the preferred release agent of this invention, tested under either wet or dry conditions, the extent of transfer falls within the range of zero to 1%.

Although the release agent must effectively prevent unwanted transfer of adhesive from one shingle to another when they are stacked prior to use, the release agent must not significantly reduce the action of the adhesive in bonding shingles together when they are installed on a roof in overlapping relation. In normal use of the shingles, such sealing action takes place when the shingles become heated by the sun to a temperature that softens the adhesive material. Typically, the adhesive noticeably softens at about 120° and becomes increasingly soft until it reaches a melting point within the range of 165° to 195°. An accepted industry standard test for determining whether an adhesive is operating effectively involves heating a pair of shingles, offset in the relationship they would assume if installed, at 135° F. for 16 hours, then separating the shingles and determining the extent of adhesive transferred from one shingle to the other. A somewhat more severe test involves conducting essentially the same procedure at a lower temperature of, for example, 120°. In either case, the results are unacceptable if the extent of transfer is not at least 40%.

To determine whether the release agent of this invention has a deleterious effect on the bonding properties of the adhesive when shingles are installed, sample shingles were first subjected to the heat test, then to the 100 psi pressure test, and finally to the 135° (or 120°) sealing test. The results show that an adhesive that would transfer to the extent of 40 to 100% without prior contact with a release agent will still transfer within that same range following direct contact with the release agent of this invention by reason of previously conducted heat tests and 100 psi pressure tests.

In preparing the aqueous dispersion for application of the release agent to the release zones of asphalt shingles, an optimum dilution ratio is believed to be about 100:1, that is, 100 parts by weight water to 1 part by weight release agent. The percentage of solids in suspension is therefore approximately 1% by weight, in contrast to conventional soap release agent solutions in which the percentage of solids is commonly 4 to 5%. Superior results in the heat and pressure tests, using the release agent of this invention, are therefore achieved with less agent being applied to the shingles (assuming that the same application techniques are used), a factor which is believed significant not only in terms of economies of manufacture but also in reducing the amount of release material that might alter the sealing effectiveness of the adhesive material in use.

Decreasing the dilution ratio increases the concentration of release agent in suspension and, assuming that the same application technique is used, increases the amount of agent deposited on the release zone or strip of each shingle. While release agent at a dilution ratio at the lower end of the range, when applied to shingles, might effectively pass the heat and pressure tests, the extent of transfer in the sealing test would tend to be at marginally acceptable or unacceptable levels. Conversely, with dilution ratios of 130:1 or more, the extent of transfer in the heat and pressure tests is either marginally acceptable or unacceptable. Consequently, the outer limits of dilution ratios is believed to be approximately 30:1 to 130:1, with the preferred ratios generally being about 80:1 to 120:1.

In adapting the method of this invention for use with roll roofing, the aqueous solution and/or dispersion of the amide release agents is applied to the entire top or upper surface of the roll roofing, which may be asphalt impregnated glass ply roofing or asphalt impregnated felt roofing. The coating is dried before the sheet material is rolled. The optimum concentration of the amides in the preferred aqueous dispersion form is around 2%, that is, using about 2 parts by weight of the mixed amides per each 100 parts of water. Alternatively or additionally, the coating may be applied to the bottom or undersurface of the sheet roofing.

The method of this invention and the asphalt roofing products thereby are further illustrated by the following examples.

EXPERIMENTAL EXAMPLE

The following Table A illustrates the results achieved when stearamide MEA and cocamide MEA were blended together with a suitable surfactant, suspended in water, and applied to the release strips or release zones of standard asphalt shingles provided on their top surfaces with conventional temperature-activated self-sealing adhesive patches. The percentages by weight of the components of each blend are indicated in parentheses, and the dilution ratio with water is also given in proportions by weight. Monamid S and SMEA are designations representing two brands of stearamide MEA obtained from Mona Industries, N.J., and Haag Laboratories Division of Millmaster Onyx, Blue Island, Ill., respectively, CMEA is a brand designation for cocamide MEA also obtained from Haag Laboratories Division.

A 130° heat test, 100 psi pressure test, and 120° seal test were all conducted as previously indicated, and the extent in area of material transferred, as a percentage of the total area of adhesive prior to testing, is represented in the table. The test marked with an asterisk (*) represents a test conducted on a shingle surface lacking the usual plastic release strip that is normally secured to the undersurface of a shingle and overlies the adhesive patches when the shingles are stacked. The diluted release agent was simply applied directly to the undersurface of the upper shingle in the area in register with the adhesive patch of the lower shingle. Results indicate that the effectiveness of the release agent may obviate the need for release strips in the form of plastic films or metal foils along the undersides of asphalt shingles to avoid the problems of undesirable bonding when such shingles are stacked.

TABLE A

| | Stearamide MEA | Cocamide MEA | Surfactant | Dilution | % Transfer 130° Heat | 100 psi Pressure | 120° Seal |
|---|---|---|---|---|---|---|---|
| 1 | Monamid S (45) | CMEA (45) | Neutronyx 656 (10) | 80:1 | 0 | 0 | 40 |
| 2 | Monamid S (45) | CMEA (45) | Neutronyx 656 (10) | 120:1 | 5 | 8 | 60 |
| 3 | Monamid S (45) | CMEA (45) | Tween 20 (10) | 100:1 | 2 | 0 | 70 |
| 4 | *Monamid S (45) | CMEA (45) | Tween 20 (10) | 100:1 | — | 0 | 40 |
| 5 | Monamid S (45) | CMEA (45) | Neutronyx 656 (10) | 100:1 | 3 | 3 | 40 |
| 6 | SMEA (47.5) | CMEA (47.5) | Neutronyx 600 (5) | 100:1 | 1 | 0 | 50 |
| 7 | SMEA (47.5) | CMEA (47.5) | Neutronyx 656 (5) | 100:1 | 1 | 0 | 50 |

The results presented in Table A compare favorably with those obtained utilizing a conventional release agent, a coconut oil soap containing about 32% solids, referenced as formulation 533, and available from Haag Laboratories Division, Blue Island, Ill. Diluting such a soap with water at the ratio of 5:1 to 8:1 by weight, in accordance with commercial practice, and then subjecting such shingles to the heat and pressure tests described above, the extent of transfer to the treated seal strip in the 130° heat test was within the range of 3 to 8% and the extent of transfer in the pressure test was within the range of 8 to 20%.

MANUFACTURING EXAMPLES

A base mixture is prepared by blending powders of the following ingredients in the relative proportions indicated:

| Ingredients | Weight Percent |
|---|---|
| Stearamide MEA | 55% |
| Cocamide MEA | 40% |
| Non-Ionic Surfactant* | 5% |
| | 100% |

Roll Roofing

For preparing a release coating solution for roll roofing, two parts by weight of the above base mixture are dissolved per 100 parts of water, the water being heated to a temperature of about 195° F. The solution is then cooled, or permitted to cool, to the ambient temperature, which may be from 60° to 80° F. During the cooling, the dissolved amides, and particularly the less soluble stearamide MEA, will come out of solution, and form a dispersion of fine particles which may approach colloidal size particles. The particles may be maintained in suspension by stirring the dispersion. The dispersion is then applied to the underside of the roll roofing by any suitable procedure such as spraying. Preferably, it is applied while the roll roofing is hot, thereby causing the water to evaporate rapidly or "flash-off". In plant operations, the roll roofing material may be at a temperature as high as from 300° to 430° F. at the time the dispersion is applied.

The method just described is further illustrated by reference to FIG. 1 of the drawing.

Tank 10 is equipped with a motor driven agitator 11 and internal heating coils 12. The tank may be provided with a top inlet 12 through which the water and the base mixture described above are introduced. The water is heated in the tank to the temperature required to dissolve the amides, such as 195° F. The solution is then transferred by means of a pump 14 through line 15 to a holding tank 16 which is equipped with a motor driven agitator 17. In tank 16, the solution is permitted to cool to ambient temperature while it is being agitated to maintain the amide in suspension as it forms fine particles. As required for application, portions of the aqueous dispersion are transferred by means of pump 18 and line 19 to a gravity feed tank 20, which may be equipped with a level controller 21, including a switch to shut off pump 18. The dispersion flows out of the bottom of tank 20 through line 22 to a spray head assembley indicated generally at 23. Between the inlet pipe 24 and the outlet pipe 25 there is suspended a series of spray heads 26, which are arranged to direct sprays of the dispersion onto the top side 27 of the roll roofing sheet material 28, the sprays being applied across the entire width of the sheet material, as shown. To provide pressure for the operation of the sprays, compressed air is introduced to the air manifold 25 through inlet pipe 29. Manifolds 24 and 25 may be equipped with auxillary devices, such as shut off valves 30 and 31, or other desirable components such as liquid strainers, air filters, etc. Pumps may be employed to provide fluid pressure for the spraying operation. Suitable spray equipment is available from commercial sources such as Spraying Systems Co., Wheaton, Ill.

During the forming of the roll roofing, a felt mat and/or a fiberglas web are impregnated with hot asphalt. Before the sheet material has cooled, such as while it is still at a temperature above 300° F., the spraying operation can be carried out to apply the release coating. Evaporation will rapidly occur leaving a thin film of the amide release agents.

Asphalt Shingles

The same base mixture described above with respect to roll roofing can be used for asphalt shingles. Further, it can be prepared in equipment like that shown in FIG. 1, including a dissolving tank, a holding tank, and an applicator tank. Spray application may also be used, but narrow sprays will be required since for use on shingles, the dispersion is applied in the form of narrow bands.

One significant difference in the preferred procedure for shingles is the use of a somewhat lower concentration of the base mixture described above can be used at about 1% concentration, that is, 1 part by weight of the base mixture per each 100 parts of water.

Figure 2:
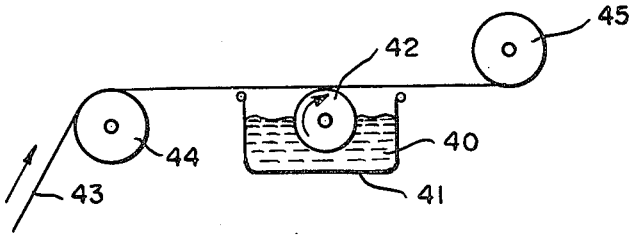

As an alternative to spraying for shingles, the aqueous dispersion and/or solution of the amides may be applied by a roll applicator. Such a system is illustrated diagramatically in FIG. 2. A coating bath 40 is provided within a tank 41 within which an applicator wheel 42, or series of applicator wheels, as preferred, are mounted for rotation. The sheet material for forming the shingles prior to cutting into shingle size, being designated by the number 43, is passed over a feed roll 44 and under a receiving roll 45 which controls the position of the sheet material over the coating bath 40. The applicator rollers 42 are positioned to engage the undersides of the plastic release strips which have been applied to the bottom side of the shingle sheet material. A coating is therefore applied to the surface of the release strips. The shingle sheet material may be at a temperature considerably above ambient temperature, such as a temperature of from 80° to 150° F. This will assist the rapid evaporation of the water from the applied coating, leaving the amide material as a solid film on the release strips.

Figure 3:
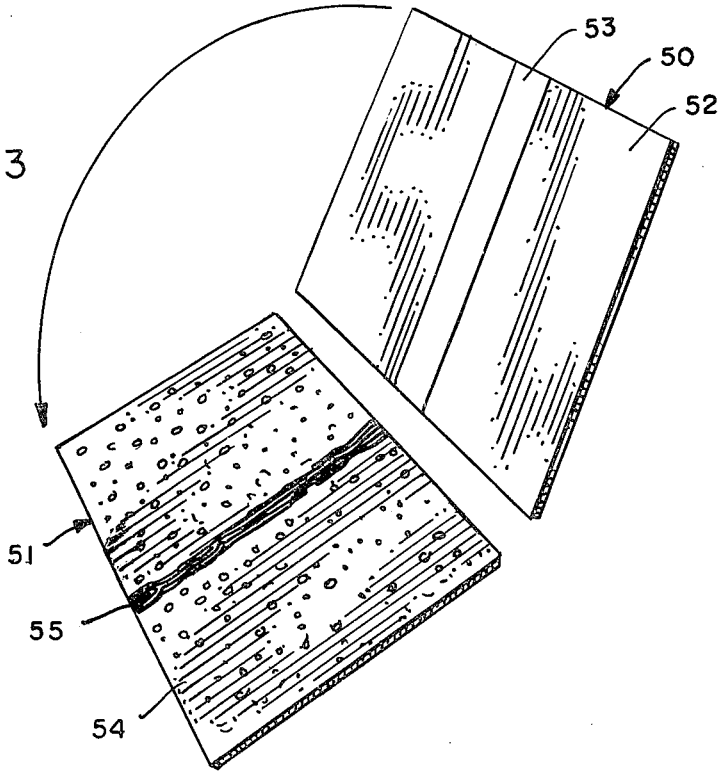

The foregoing description can be understood more clearly by reference to FIG. 3 which shows two shingles 50 and 51 in separated relation.

52 of the upper shingle is shown as provided with the release strip of plastic film 53 extending across the central portion thereof. The lower shingle 51 is shown as having its upper aggregate-coated surface 54 provided with an adhesive attachment strip 55. The strip 55 and the tape 53 are arranged so that they will be superimposed when the shingles are stacked. By having the amide coating on the underside of the tape 53, easy and convenient release from the adhesive strip 55 will be provided, and little or none of the adhesive will be lost by adherence to the tape when the shingles are separated. As with present practice, the areas of the undersides of the shingles on each side of the tapes 53 will be dusted with talc. Alternatively, however, the entire undersurface of the shingles could be coated with a release coating, such as a 2% dispersion coating, as described with reference to the roll roofing application.

I claim:

1. The method of treating a surface of an asphalt roofing sheet material preparatory to stacking or rolling to prevent adherence of the treated surface to another surface of the roofing material, comprising depositing on the surface to be treated a thin coating of fatty acid monoalkanol amides having the general formula $$R-\overset{\overset{\displaystyle O}{\|}}{C}-\overset{\overset{\displaystyle H}{|}}{N}-R_1OH$$

wherein R is an aliphatic hydrocarbon group containing from 11 to 17 carbons and $R_1$ is an alkyl group containing from 1 to 3 carbons.

2. The method of claim 1 in which said coating is composed of a mixture of cocamide MEA and stearamide MEA.

3. The method of claim 2 which said amides are present in proportions by weight of from 30 to 70 parts of cocamide MEA with 70 to 30 parts of stearamide MEA.

4. The method of claim 1 in which said amides are deposited on said surface from an aqueous dispersion thereof.

5. The method of treating a surface of an asphalt roofing sheet material preparatory to stacking or rolling to prevent adherence of the treated surface to another surface of the roofing material, comprising dissolving a mixture of fatty acid monoalkanol amides in water at an elevated temperature to form a dilute solution thereof, said amides having the general formula $$R-\overset{\overset{\displaystyle O}{\|}}{C}-\overset{\overset{\displaystyle H}{|}}{N}-R_1OH$$

wherein R is an aliphatic hydrocarbon group containing from 11 to 17 carbons and $R_1$ is an alkyl group containing from 1 to 3 carbons, cooling the solution to a temperature at which most of the amides are present as a dispersion of colloidal particles, applying said dispersion to the surface to be treated, and forming a dry coating thereon of said amide mixture.

6. The method of claim 5 in which said dispersion has a concentration of from 0.5 to 2.5 parts by weight of amides per 100 parts of water.

7. The method of claim 5 which said coating is composed of a mixture of cocamide MEA and stearamide MEA.

8. The method of treating a surface of an asphalt roofing sheet material preparatory to stacking or rolling to prevent adherence of the treated surface to another surface of the roofing material, comprising dissolving a mixture of cocamide MEA and stearamide MEA in water at an elevated temperature, said amides being present in proportions of from 30 to 70 parts by weight of cocamide MEA to 70 to 30 parts of stearamide MEA, said solution containing from 0.5 to 2.5 parts by weight of total amides per each 100 parts of water, cooling the solution to a temperature at which most of the amides are present as a dispersion of colloidal particles, applying said dispersion to the surface to be treated, and forming a dry coating thereon of said amide mixture.

9. The method of claim 8 in which said roofing material is asphalt shingles having adhesive asphalt seal strips on their upper sides and release tapes on their undersides positioned to mate with said seal strips when said shingles are stacked, said aqueous dispersion being applied to the upper surfaces of said release strips to form a release coating thereon.

10. The stackable asphalt shingles produced by the method of claim 9.

11. The method of claim 8 in which said roofing sheet material is roll roofing, said aqueous dispersion being applied to the top side thereof to form a release coating thereon before it is rolled.

12. The rollable roofing material produced by the method of claim 11.

* * * * *